US006049928A

United States Patent [19]

Helmsderfer

[11] Patent Number: 6,049,928

[45] **Date of Patent: *Apr. 18, 2000**

[54] BABY DIAPER CHANGING STATION

[76] Inventor: John A. Helmsderfer, Windsor Ave., Cincinnati, Ohio 45206

[ * ] Notice: This patent is subject to a terminal disclaimer.

[21] Appl. No.: 09/013,971

[22] Filed: Jan. 27, 1998

Related U.S. Application Data

[62] Division of application No. 08/478,951, Jun. 7, 1995, Pat. No. 5,802,647.

[51] Int. Cl.[7] ..... A47D 5/00

[52] U.S. Cl. ..... 5/655; 5/949; 5/136; 5/908; 5/160

[58] Field of Search ..... 5/136, 160, 429, 5/655, 280, 908, 949; 108/38, 40; 40/594, 611

[56] References Cited

U.S. PATENT DOCUMENTS

D. 179,871 3/1957 Wrablica, Jr. .
D. 243,048 1/1977 Touchett .
D. 243,213 2/1977 Kormos .
D. 246,682 12/1977 Nakao .
D. 248,805 8/1978 Bridges .
D. 249,991 10/1978 Bridges .
D. 250,800 1/1979 Trossman .
D. 251,039 2/1979 Reppas .
D. 255,734 7/1980 Liebman .
D. 260,827 9/1981 Sommer .
D. 263,532 3/1982 Ferdinand et al. .
D. 265,703 8/1982 Zaro .
D. 267,843 2/1983 Sundberg .
D. 272,402 1/1984 Marrujo .
D. 274,105 6/1984 Brescia et al. .
D. 277,819 3/1985 Crosslen .
D. 283,189 4/1986 Hampton .
D. 284,530 7/1986 Riehm .
D. 284,531 7/1986 Riehm .
D. 284,723 7/1986 Morris et al. .
D. 287,200 12/1986 Gecchelin .
D. 287,318 12/1986 Garduno .
D. 293,403 12/1987 Umanoff .
D. 293,404 12/1987 Murphy .
D. 294,096 2/1988 Murphy .
D. 295,007 4/1988 Hardy et al. .
D. 299,687 2/1989 Handler et al. .
D. 302,088 7/1989 Burt .
D. 312,185 11/1990 Prater, Sr. .
D. 313,516 1/1991 Socher .
D. 314,112 1/1991 Dainty .
D. 314,486 2/1991 Day .
D. 318,307 7/1991 Hahn et al. .
D. 322,531 12/1991 Hobson .
D. 325,309 4/1992 Worrell .
D. 325,826 5/1992 Brunner et al. .
D. 326,384 5/1992 Burt et al. .
D. 327,786 7/1992 Ferrell .

(List continued on next page.)

FOREIGN PATENT DOCUMENTS 638815 6/1950 United Kingdom ..... 5/159.1

*Primary Examiner*—Michael F. Trettel
*Attorney, Agent, or Firm*—Wood, Herron & Evans, LLP

[57] ABSTRACT

A baby diaper changing station comprises a base and a support platform hingedly mounted at one side to the base and a rail structure on at least one side of the platform to increase the effective depth of the platform. A utility channel surrounds the platform for holding various diaper changing supplies and removable protective panels are positioned on bottom and side surfaces of the platform to reduce vandalism damage. A waste chute is formed in the base or support platform of the diaper changing station and cooperates with a waste receptacle proximate the station for receiving used diapers and other related waste. Accessory hooks on the platform are configured to receive and hold diaper changing supplies, such as a diaper bag. An alternative embodiment of the diaper changing station utilizes a platform having nested sections which telescope to increase the effective depth of the platform.

17 Claims, 7 Drawing Sheets

U.S. PATENT DOCUMENTS

| | | | |
|---|---|---|---|
| D. 329,950 | 10/1992 | Takahashi et al. . | |
| D. 332,197 | 1/1993 | Chase . | |
| D. 333,389 | 2/1993 | Saito et al. . | |
| D. 333,923 | 3/1993 | Dainty . | |
| D. 336,192 | 6/1993 | Wedeking . | |
| D. 338,110 | 8/1993 | Peay . | |
| D. 344,869 | 3/1994 | Paradis et al. . | |
| 879,050 | 2/1908 | Ingram et al. | 5/159.1 X |
| 2,174,363 | 9/1939 | Eubank . | |
| 2,735,737 | 2/1956 | Hancock | 5/947 X |
| 3,656,193 | 4/1972 | Schneider et al. . | |
| 3,696,293 | 10/1972 | Egan, Jr. et al. . | |
| 4,074,635 | 2/1978 | Stauble . | |
| 4,125,192 | 11/1978 | Dayen . | |
| 4,133,063 | 1/1979 | Jones-Steele . | |
| 4,205,669 | 6/1980 | Hamann . | |
| 4,216,951 | 8/1980 | Griffin | 5/488 X |
| 4,522,381 | 6/1985 | Ludwick . | |
| 4,527,830 | 7/1985 | Meyers . | |
| 4,573,608 | 3/1986 | Hansen | 5/947 X |
| 4,613,996 | 9/1986 | Chase et al. | 5/947 X |
| 4,633,789 | 1/1987 | Kortering et al. . | |
| 4,648,766 | 3/1987 | Wollar . | |
| 4,712,258 | 12/1987 | Eves . | |
| 4,723,493 | 2/1988 | Siani et al. . | |
| 4,788,726 | 12/1988 | Rafalko . | |
| 4,796,314 | 1/1989 | Garduno . | |
| 4,876,970 | 10/1989 | Bolduc | 5/947 X |
| 4,953,312 | 9/1990 | Astolfi . | |
| 4,965,896 | 10/1990 | Berger et al. . | |
| 4,972,532 | 11/1990 | Juan . | |
| 4,978,093 | 12/1990 | Kennedy . | |
| 5,072,979 | 12/1991 | Swinton . | |
| 5,081,724 | 1/1992 | Takahashi et al. | 5/136 |
| 5,084,927 | 2/1992 | Parkevich . | |
| 5,086,527 | 2/1992 | Takahashi et al. | 5/947 X |
| 5,161,270 | 11/1992 | Najmabadi . | |
| 5,265,296 | 11/1993 | Abbas et al. . | |
| 5,802,647 | 9/1998 | Helmsderfer | 5/655 X |

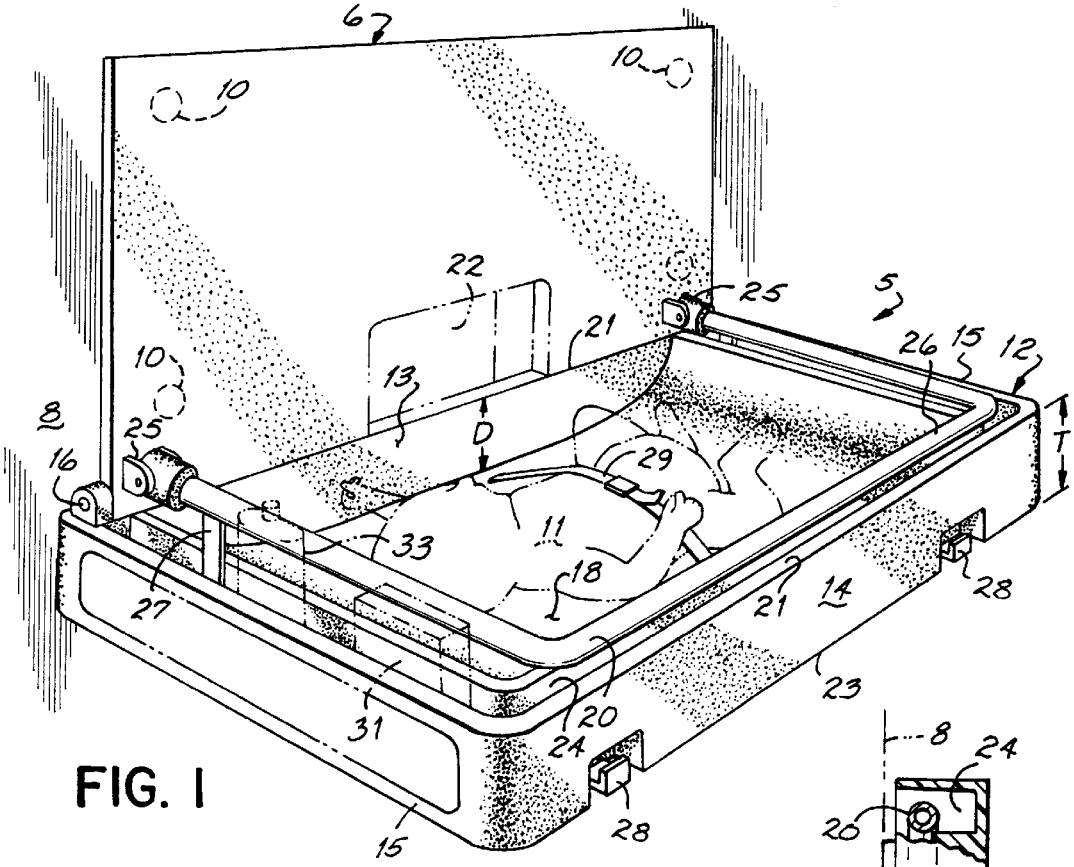
FIG. I
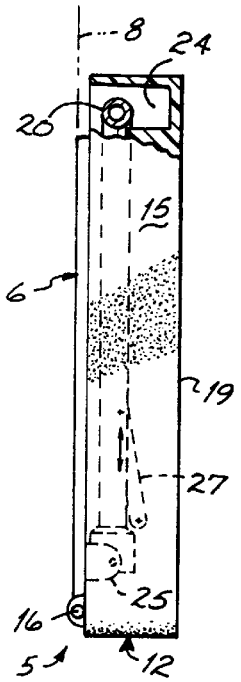
FIG. IB
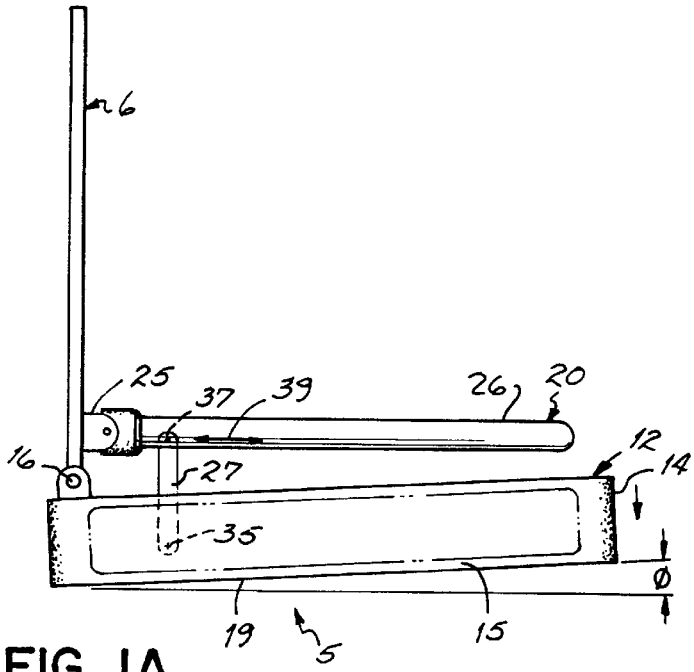
FIG. IA

BABY DIAPER CHANGING STATION

This application is a divisional application of U.S. Ser. No. 08/478,951, filed Jun. 7, 1995, now U.S. Pat. No. 5,802,647 and entitled "Baby Diaper Changing Station", which application is incorporated by reference herein in its entirety.

FIELD OF THE INVENTION

The present invention relates to an apparatus to be placed in a restroom for changing the diapers of an infant.

BACKGROUND OF THE INVENTION

Apparatuses for changing the diapers of a baby or "changing a baby" and other small children not yet toilet trained, have become widely used, such as in public restrooms, to assist a parent or other child supervisor when changing a baby's diapers. Such baby diaper changing apparatuses, often times referred to as simply baby changing stations, have taken various forms as evidenced by patents in the field, and generally take the form of a base which is mounted vertically onto a surface of a wall and a support platform or surface which is hingedly mounted to the base to hinge down from the base and lie generally horizontal to support a baby. While available baby changing apparatuses may operate sufficiently for the primary purpose of offering a generally flat surface on which to rest a baby during a diaper change, the currently available apparatuses have various drawbacks and often do not adequately address the needs of the infant and the parent which arise during a diaper change procedure.

Pursuant to various laws and codes regarding public restroom facilities, such as the Americans With Disabilities Act (ADA). Baby changing stations and other wall mounted objects within the restroom must not protrude from the wall greater than approximately four inches. The four inch specification must be met when the baby changing station is in the closed or up position As may be appreciated, the effective depth of any top surface of the support platform is generally restricted by the thickness of the support platform. Existing baby changing apparatuses have effective depths which are necessarily less than four inches so that they do not protrude from the wall a distance greater than allowed in the regulations. Such a relatively shallow platform surface is often not adequate for containing older babies and toddlers who may still require diaper changes. Toddlers are generally stronger and more active than newborn babies, and therefore may struggle more during a diaper changing. It is therefore one object of the present invention to provide enhanced safety for all babies and particularly additional security for larger and more active babies and toddlers during the changing process.

Some of the existing baby changing stations includes straps which are held together across a baby by VELCRO® brand hook and loop fasteners or some other suitable fastening mechanism. However, the baby is often placed on top of the straps and the parents do not use them apparently due to the inconvenience of securing them or due to the size of the child being changed. Therefore, it is another objective of the baby changing station to automatically enhance the safety of a baby on the station without requiring specific procedures by the parent or child attendant.

Existing baby changing stations are also particularly subject to defacement since they are located on the walls of public restroom facilities. When the baby changing station is in the up position, it presents a large outer surface area which somewhat invites vandalism. Vandals generally mark the outer surface with graffiti and scrape and abrade the exposed surfaces. As may be appreciated, such vandalism discourages use of the changing station by protective parents and further degrades the overall appearance of cleanliness within the restroom facility sending a message of neglect to users of the facility. The graffiti and vandalism is often permanent on the exposed surfaces of the changing station and requires the costly remedy of replacing the entire changing station. Therefore, it is an objective of the invention to reduce the costly and permanent damage from vandalism of baby changing stations. It is a further objective of the invention to reduce the necessity of replacing entire changing stations because of graffiti and vandalism.

Presently available baby changing stations utilize baby-supporting surfaces which are often barely large enough to hold a baby. Therefore, the person changing the baby is faced with difficulties in arranging and using the various supplies such as lotions, powders, extra diapers and baby wipes which are utilized when changing a baby. Since, existing changing stations provide only a flat surface for changing a baby, the supplies must be placed on the floor or precariously placed next to the baby on the changing surface. As may be appreciated, parents are often very reluctant to place changing supplies on a dirty bathroom floor, and therefore, are often left wedging such supplies on the support surface against the baby creating an inconvenient environment and discomfort to the baby. Furthermore, a person changing the baby is often left holding a dirty diaper which must be placed within the diaper bag or carried to a bathroom waste can, thereby creating a situation where the baby is left unattended. Accordingly, it is another objective of the present invention to provide a more convenient, safe and efficient environment for changing a baby within a restroom facility.

An additional drawback to existing baby changing apparatuses is the fact that most such apparatuses are fabricated of a single neutral color which, more often than not, does not match the color schemes of tile and vanity surfaces utilized within the restroom facility. Contractors, architects and the owners of public facilities often go to great lengths to present a clean and efficient restroom area with a pleasing design and color scheme. Often the colors are corporate colors and are used in all restroom facilities in a particular establishment, such as a fast-food restaurant chain. Existing single color baby changing apparatuses detract from the overall decor because their large, neutral exposed surfaces clash with the colors within the restroom area. Furthermore, since the off-color baby changing apparatuses are mounted to a wall, they are particularly noticeable, further detracting from the decor. When the baby-supporting platform is in an up and closed position, the large amount of exposed surface area against the wall of the restroom presents a distinct clash with other restroom apparatuses and surfaces. Therefore, it is another objective of the present invention to present a more uniform decorative impression within a public restroom facility utilizing a baby changing apparatus.

For practical reasons, the baby changing stations will not be cleaned each time they are utilized. Therefore, several babies may be changed between cleanings leaving a dirty or soiled changing surface. As a result, other parents may be reluctant to use the changing station. Therefore, it is another objective of the present invention to economically and efficiently provide a clean, sanitary surface on which to change a baby, even after the apparatus has been used for multiple changings.

It is still another objective to present a baby changing apparatus which is easy to install and utilize and which provides a convenient environment for changing a baby without drastically increasing the size of the apparatus or increasing its projection depth from a wall surface.

All of the above-stated objectives must be accomplished while meeting specific construction codes and regulations pertaining to baby changing stations and other restroom fixtures. As discussed, the Americans With Disability Act (ADA) states that the projections depth from wall of a baby changing stations must be four inches or less. Therefore, it is a further objective to provide a baby changing station which addresses the aforementioned objectives while meeting current regulations.

SUMMARY OF THE INVENTION

The above-discussed objectives are achieved by a baby changing station of the present invention which assists a person changing a baby and increases the convenience and efficiency of the changing procedure as well as the safety of the baby. Furthermore, the inventive baby changing station presents an unobtrusive and aesthetically pleasing fixture in a facility, such as a public restroom facility, which is less apt to be permanently defaced by graffiti and other vandalism, and thus, less apt to require replacement after continuous usage. The baby changing station of the invention provides a sanitary environment and eliminates the need for the parent to constantly move around to obtain changing supplies or to dispose of waste products, thus allowing them to concentrate on the important task at hand.

In accordance with the principles of the invention, the baby changing station comprises a wall-mounted base and a support platform hingedly mounted at one side thereof to the base to move between an opened position, wherein the platform is substantially perpendicular to the wall and a closed position, wherein the platform is up against the wall. The baby changing station of the present invention preferably has a generally concave top surface for receiving a baby and has an effective depth greater than existing apparatuses for securing a baby thereon. Specifically, the changing station comprises a rail structure which is automatically moved into an erected position to be adjacent at least one side of the platform when the platform is moved into the opened position to receive a baby. The rail structure has a top edge which is located preferably around four inches above the top edge of the support platform to increase the effective depth of the platform. The rail structure effectively creates a wall on at least one side of the platform to enhance the safety of the changing environment. The rail is further operable to move to a collapsed or stored position between the wall and the support platform when the platform is moved to the closed position against the wall.

In one embodiment of the invention, the rail structure comprises an elongated cylindrical rail which surrounds the platform and is hingedly mounted at its ends to the base of the changing station or to the wall. The rail preferably surrounds the platform to effectively create a wall at the outer side and the ends of the platform. The rail is operably coupled to the platform with a linkage structure such that the platform is automatically positioned in an erected position around the platform when the platform is moved to the opened position away from the wall. When the platform is moved to a closed position against the wall, the rail is automatically moved to a collapsed position by the linkage structure and fits within a utility channel formed around the platform.

The utility channel preferably surrounds the platform and is formed between the outer side and is formed between the outer side and ends of the platform and the side and ends of the top surface. The channel of the invention receives various changing supplies such as powder, lotion and extra diapers. The supplies in the channel are maintained proximate a top surface of the platform and are thereby readily accessible to the person changing the baby's diapers. An accessory hook projects outwardly from an end or a side of the support platform next to the channel. The hook is located at a position on the peripheral edge of the platform and is easily accessible to a person using the station. The hook is configured to received and support necessary changing supplies, such as a diaper bag which may be too large to place within the utility channel. Additional hooks may be utilized in accordance with the principles of the invention, such as for receiving and holding a purse.

Alternatively, the rail structure comprises a wall member movably mounted at the outer side of the support platform which extends generally perpendicular to the platform when the platform is in an open position. The wall member is mounted to the platform and is operable to automatically move to an erected position when the platform is opened. The wall member then automatically moves to a retracted or closed position when the platform is moved to the closed position against the wall. The retracted position of the rail structure allows the support platform to mount tightly against the wall. One embodiment of the wall member is hingedly mounted to the support platform with spring-biased hinges which move the wall member to a perpendicular position when the platform is open but which allow the wall member to collapse and lie flat against the platform when the platform is closed. Another embodiment of the wall member is spring-mounted within a cavity formed in the support platform. When the platform is open, the spring-mounted wall member extends generally perpendicular to the platform; when the platform is closed, the spring-mounted wall member retracts inwardly into the cavity so that the platform may be closed tightly against the wall when not in use.

The rail structures of the present invention automatically and effectively create a platform having relatively deep effective depth in which to change a baby; however, when placed in the closed position, the support platform does not project from the wall greater than approximately four inches, which is the code limit for such a restroom fixture. The automatically deployed rail structure of the present invention does not require deployment interaction by the person changing the baby and thus are not subject to being unused during use of the changing station.

When the support platform of the baby changing station of the invention is in a closed position up against the wall, the top surface of the platform is against the wall and is generally hidden from view. However, the large bottom surface is exposed for view and is therefore particularly susceptible to vandalism and graffiti. The changing station of the present invention further comprises a generally planar protective panel configured to overlie the bottom surface of the platform to provide an exposed surface when the support platform is closed against the wall. The panel is removably mounted to the platform and is preferably fabricated of a laminate material which is more abrasion resistant than the material of the platform to resist vandalism. If defaced, the panel may be easily removed and replaced with a new panel thus eliminating the need to clean or replace the entire changing station when the exposed bottom surface is vandalized. Thus, the invention results in substantial clean-up and replacement cost savings. A similar protective panel may be used on end surfaces of the platform in accordance with the principles of the invention.

Furthermore, the protective panel is colored or patterned to match the decor of a restroom facility. Thus, although the station is made of a neutral or unmatching color, a large portion of the exposed bottom surface will match the decor giving a more pleasant and unobtrusive appearance to the station when installed. If the color scheme of the restroom is changed, a new panel may be installed to match.

The protective panel is preferably flush with the bottom surface and is attached by screws, rivets or other suitable fastening structure, such as adhesives or hook and loop fasteners (VELCRO®), brand hook and loop fasteners into a recess formed in the bottom surface. Alternatively, the protective panel is placed within a frame structure which is then affixed to the bottom surface of the support platform. In a further alternative embodiment, the bottom surface of the support platform includes grooves formed along opposing edges of the bottom surface. The protective panel is slid or otherwise positioned into the bottom surface recess between the opposing grooves. In still a further embodiment, the protective panel is configured integrally with the form of a protective cap. The protective cap and panel engage the bottom surface of the platform to protect the bottom surface.

The baby changing station of the invention provides a sanitary top surface for changing the baby and comprises a roller containing a rolled sheet of sanitary paper mounted within a cavity formed at an end of the support platform. Preferably, the uppermost surface of the rolled sheet of paper is generally flush with the uppermost surface of the platform so that the platform lies flat against the wall when closed. The paper is pulled from the roller at one end and stretched to the opposite end of the platform to generally cover the top surface and provide a sanitary environment on which to change a baby. When the paper is used or soiled, it may be torn away from the roller and placed within a waste receptacle. New paper is then pulled over the platform surface. The top surface of the platform of the invention is thus maintained in a clean condition for subsequent users.

A waste chute is formed in the support platform or the base for disposing of waste material such as dirty diapers or used surface paper in combination with an in-line waste receptacle for receiving the waste material. The chute is operatively coupled to the waste receptacle which is preferably positioned beneath and behind the changing station platform. The waste chute mouth or inlet end is formed in the platform or wall base proximate the top surface of the platform for ready access. The waste receptacle is preferably recessed within or surface mounted on the wall to which the baby changing station is mounted, and has an opening which aligns with an outlet end of the chute. When waste is placed in the chute, the chute is operable to conveniently and readily transfer the waste to the receptacle. Alternatively, a free-standing waste receptacle might be placed in line with the outlet end of the chute to receive waste. Thereby, used diapers and wipes and other materials may be readily and easily disposed of right at the changing station without leaving the baby unattended.

In accordance with the principles of the invention, a deeper effective platform surface is also achieved by the present invention without the use of a rail structure. In an alternative embodiment of the invention, the support platform of the station comprises a first section which is hingedly mounted at one side to the base and a second section which is telescopically mounted inside the first section to nest within the first section. The first section preferably includes a lip around the bottom periphery thereof which abuts against an opposing lip around the top periphery of the second section when the platform is open to hold the platform sections in telescoping relation. When the support platform is open, the second section drops under its own weight or the weight of a baby thereon and telescopes away from the first section to form a relatively deep concave or drawer-shaped platform for supporting the baby. A spring biasing device is coupled between the opposing peripheral lips. When the baby is removed and the platform is moved to a closed position, the second section is pushed by the biasing device to telescope toward the first section and nest within the first section and present a relatively thin support platform against the wall surface. Preferably, the first and second sections are configured such that the second section nests completely inside of the first section when the platform is closed. Such an embodiment produces a safe changing platform with a deep effective depth, when open and simultaneously provides a thin profile when in a closed position against the wall for complying with the applicable building codes.

In a further alternative embodiment of the invention, the baby changing station includes support platform which mounts proximate a recess formed in the wall. The support platform is movable to a closed position up against the wall and is configured to rest inset within the wall recess. When in the closed position, the platform bottom surface is spaced from the surface of the wall a distance which is less than the platform thickness. Thereby, the platform may have a thickness, and thus effective depth, greater than applicable building codes allow but would still meet with the applicable codes in the closed position. In one embodiment, the support platform is hinged at one side to a base casing and the casing is configured to received the platform therein. The platform is movable into a closed position in which the platform fits snugly into the base and is held recessed therein with respect to the wall surface. The casing is preferably dimensioned such that the platform is generally flush with the wall surface when in the closed position. The station has a platform and a base casing with an effective depth of greater than four inches in the open position to enhance the safety of the baby thereon. However, when closed, the platform does not extend away from the wall surface greater than four inches. As a result, a deep effective surface is presented for changing the baby while a thin wall profile, which complies with applicable codes, is maintained.

Further features and advantages of the baby changing station of the present invention are set forth in the Brief Description of the Figures and Detailed Description of the Invention set forth hereinbelow.

BRIEF DESCRIPTION OF THE FIGURES

The accompanying drawings, which are incorporated in and constitute a part of this specification, illustrate embodiments of the invention, and together with a general description of the invention given above, and the detailed description of the embodiments given below, serve to explain the principles of the invention.

FIG. 1 is a perspective view of a baby changing station in the opened position in accordance with the principles of the present invention;

FIG. 1A is a side view of the baby changing station of FIG. 1 in the opened position;

FIG. 1B is a side view, in partial cross section, of the station of FIG. 1, when the station is in the closed position;

DETAILED DESCRIPTION OF SPECIFIC EMBODIMENTS

Figure 2:
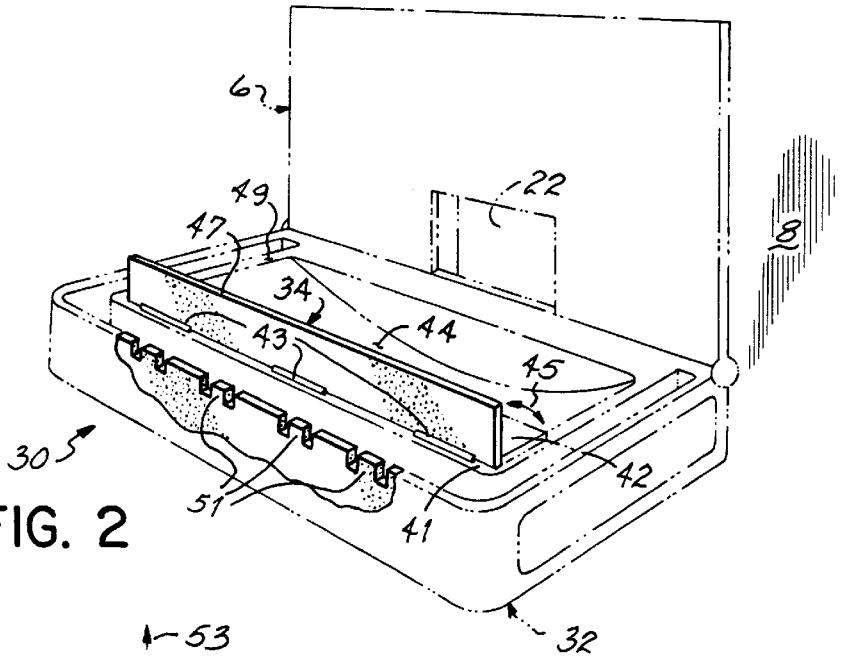
FIG. 2 is a perspective view of an alternative embodiment of the baby changing station of the invention in the opened position.

FIG. 1 illustrates an embodiment of the baby changing station 5 in accordance with the principles of the present invention. Baby changing station 5 includes a generally planar base 6 which is mounted flat against a wall 8 by appropriate mounting structures 10, such as bolts or screws. Station 5 comprises a support platform 12 for supporting a baby 11 which needs its diapers changed. The support platform 12 is preferably rectangular and has an inner side 13, an opposing outer side 14 and opposing sides 15. The platform 12 is mounted at its inner side 13 to hinge with respect to wall 8 and specifically is mounted to the bottom of base 6 by hinges 16 which produce hinged movement of platform 12 between an opened position as shown in FIG. 1, wherein the platform lies generally perpendicular to planar base 6 and wall 8 to receive a baby thereon, and a closed position, as illustrated in FIG. 1B, wherein platform 12 is hinged up against base 6 and wall 8. The platform 12 is generally mounted normal to the vertical planes of base 6 and wall 8 in the opened position as illustrated in FIG. 1A. In the closed position, platform 12 is generally parallel the planes of base 6 or wall 8. If a base 6 is not utilized, platform 12 may be mounted directly to wall 8 to hinge therefrom. The top surface 18 of platform 12 is preferably concave in shape as shown in FIG. 1. The concave top surface 18 extends into the platform 12 with respect to a top edge 21 of the platform to create a recessed surface in platform 12 for receiving a baby when the platform is in the opened position (FIG. 1). When the platform 12 is in the closed position, the platform top surface 18 is against base 6 and generally hidden from view while the platform bottom surface 19 is exposed. The distance between the lowest most point on the concave surface 18 and the top edge 21 is defined as the effective depth D of the platform. The distance between the top edge 21 and bottom edge 23 of the platform defines the thickness T of the platform. The thickness T is preferably approximately four inches which meets the specifications set forth in construction and building regulations for public restroom facilities, most notably the ADA. Preferably base 6 is dimensioned rectangularly smaller than platform 12 such that the platform 12 completely covers the base 6 when in the closed position (see FIG. 1B).

Baby changing station 5 further comprises a rail structure 20 which is also preferably hingedly mounted to base 6 for automatic movement when platform 12 moves between opened and closed positions. Rail structure 20 may be hingedly mounted to wall 8 if a base 6 is not utilized. Rail structure 20 is hingedly mounted, such as with brackets 25, and is operably linked to platform 12 by an appropriate linkage structure such as link arms 27. When platform 12 is moved to the opened position, the rail structure 20 automatically moves to an erected position. When erected, the rail structure 20 has an upper edge 26 which is preferably positioned above top edge 21 approximately four inches. The rail structure 20 is further operable, via linkage arms 27, to move into a collapsed position up against wall 8 when platform 12 is moved to the closed position.

Referring to FIG. 1A, rail structure 20 is positioned above the top edge 21, approximately four inches above edge 21, and surrounds top surface 18 and creates an effectively deeper platform on which a baby may be changed. Rail structure 20 reduces the possibility that a baby may roll or otherwise move off of the platform during changing. In a preferred embodiment, the concave depth D of top surface 18 is over three inches while the rail structure 20 is located around four inches above edge 21. Therefore, in accordance with the principles of the present invention, the baby changing station has a platform with an effective depth of over seven inches. When closed, however, platform 12 only has a projection away from wall 8 of approximately four inches to thereby meet the necessary building regulations. As discussed below a channel 24 receives rail structure 20 when platform 12 is in the closed position. Preferably, platform 12 is hingedly mounted to base 6 at an elevated angle θ. When the baby is then placed on platform 12, the platform then hinges further downwardly under the baby's weight to remain generally perpendicular to base 6. To further enhance the safety of baby changing station 5, a safety belt 29 might be fixed to platform 12 by means not shown to extend across top surface 18 and strap the baby 11 to the platform 12.

Platform 12 includes a utility channel 24 formed therein and surrounding the top surface 18. Channel 24 extends around the platform 12 and provides a convenient receptacle for baby changing supplies such as diapers 31, lotions 33, and/or moist baby wipes (not shown). The channel 24 holds the changing supplies proximate the top surface 18 and proximate baby 11 thereon for convenient and ready access during diaper changing. The baby changing station 5 of the invention thereby increases the efficiency of a parent or other child caregiver changing a baby by eliminating unnecessary searching or fumbling for supplies located away from the baby. Station 5 also comprises a waste chute 22 for disposing of used diapers and other waste articles as well as protective panels for reducing the affects of vandalism. The waste chute 22 and panels are discussed further hereinbelow.

Furthermore, channel 24 is configured around top surface 18 to receive the rail structure 20 when platform 12 is closed. Referring to FIG. 1B, the rail structure 20 seats within channel 24 when the platform is in the closed position thereby ensuring a tight closure against base 6 and wall surface 8. The linkage arms 27 are pivotally mounted to platform 12 at point 35 and are slidably and pivotally mounted to rail structure 20 at point 37 such as in a slot (not shown). When platform 12 is folded to an opened position, linkage arms 27 move toward the base 6 to point 37, as illustrated by arrow 39, and automatically pull rail structure 20 into an erected position (see FIG. 1A). When platform 12 is moved to a closed position, the arms slide away from base 6 and automatically push rail structure 20 to a collapsed position against wall 8 (see FIG. 1B). When the platform 12 is closed and rail structure 20 is collapsed, the rail structure fits entirely within utility channel 24 and around top surface 18 as illustrated in FIG. 1B. In that way, platform 12 lies snug against wall 8 with plane 17 generally parallel to the plane of the wall and the rail structure 20 also resting in a plane generally parallel to wall 8.

As discussed further below, changing station 5 also comprises utility hooks 28 which are configured to receive the straps of a purse or diaper bag (see FIG. 3). The utility hooks 28 of station 5 allow the person utilizing the station to keep their personal items close to them and off the floor without requiring them to wedge the items somewhere on top surface 18 where the diapers are changed. This further increases the efficiency and ease of diaper changing.

FIG. 2 illustrates the baby changing station 30 of the invention with an alternative rail structure for increasing the effective depth of the platform 32. As seen in FIG. 2, the support platform 32 is hinged to a downward and opened position such that the platform 32 is generally perpendicular to the base 6 to receive a baby (not shown) for diaper changing. In FIGS. 1, 1A and 1B, the rail structure 20 comprised an elongated rail which extended around the platform 12. Station 30 uses a solid, flat wall element 34 which is movably mounted on at least one side of the platform 32. Wall element 34 is hingedly mounted proximate the outer side 41 of the concave top surface 18. Wall element 34 has an erected position in which it extends generally perpendicular to the platform 32 when platform 32 is in an opened position. Wall element 34 thereby provides containment at the outer side 41 of the top surface 18 to effectively contain a baby on platform 32. As may be appreciated, a baby will generally tend to roll from side to side when moving and will usually not move toward an end of the platform. Therefore, wall element 34 at the outer side of platform 32 will provide containment in conjunction with base 6. Wall element 34 increases the effective depth of the platform top surface 44 similar to the rail structure 20 in FIG. 1.

Wall element 34 is mounted to platform 32 by a plurality of spring biased hinges 43. When platform 32 is opened, the spring hinges bias wall element 34 to the erected position in the direction of arrow 45 such that the wall element 34 extends generally perpendicular to the plane of platform 32. A top edge 47 of wall element 34 is located above the top edge 49 of surface 44 to increase the effective depth of the concave surface 44. When the support platform 32 is closed, i.e., it is moved against base 6, the wall element 34 is pressed at its top edge 47 by base 6 and is operable to collapse or retract against platform 32 to lie generally parallel with the platform 32, as illustrated in phantom by reference numeral 42. In that way, when the support platform 32 is closed, wall element 34 lies generally flat against base 6 and parallel to the wall surface 8 for a tight closure, and the platform 32 does not extend outwardly from the wall a distance greater than that allotted by the applicable building regulations. Platform 32 includes utility hooks in the form of upstruck teeth 51 discussed below, and the baby changing station of FIG. 2 includes a waste chute 22.

Figure 3A:
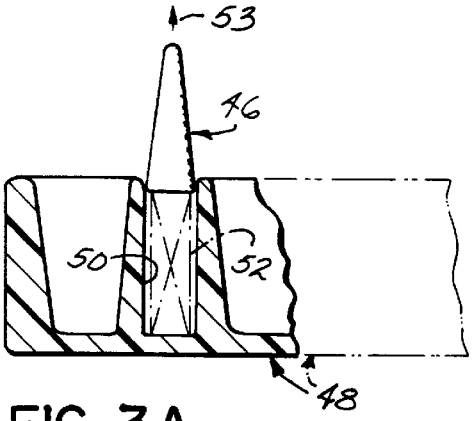
FIG. 3A is a side view, in partial cross-section, illustrating the rail structure of FIG. 3 in an erected position.
Figure 3B:
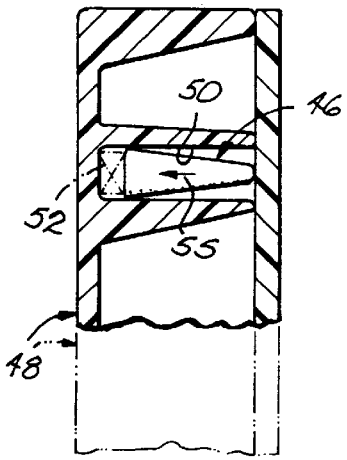
FIG. 3B is a side view, in partial cross-section, illustrating the rail structure of FIG. 3 in a collapsed position.
Figure 3:
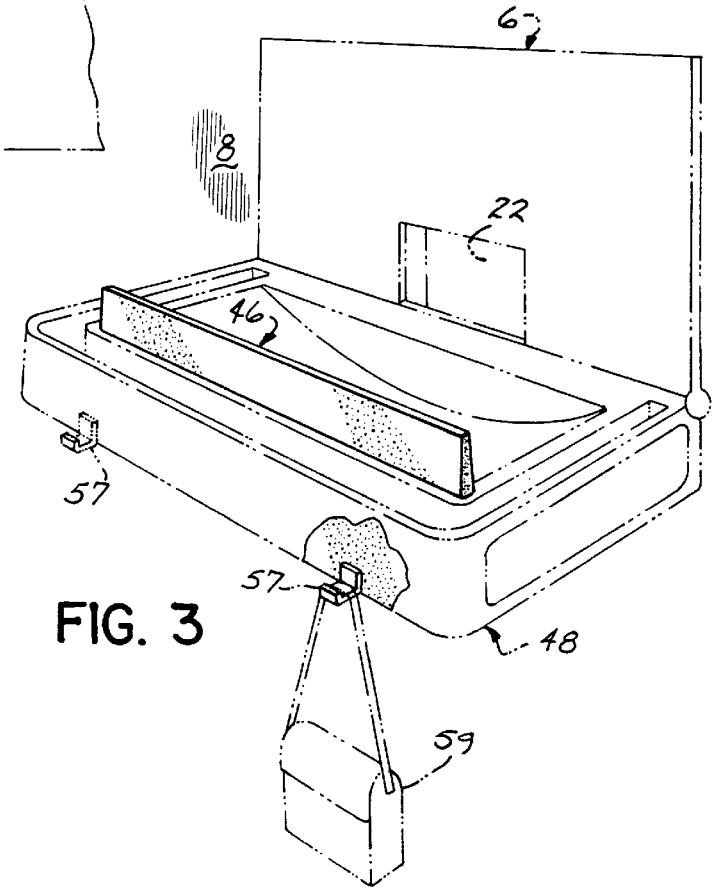
FIG. 3 is a perspective view of an alternative embodiment of the baby changing station of the invention in the opened position.

FIGS. 3, 3A and 3B illustrate another alternative embodiment of the rail structure. Referring to FIG. 3, the rail structure is a flat wall element 46 similar to wall element 34 and extends generally perpendicular to the plane of platform 48 in the erected position. Wall element 46 is supported on platform 48 within a cavity 50 formed within platform 48. Rail structure 46 moves within the cavity 50 and is biased by a biasing mechanism 52 which may be a spring or other suitable biasing mechanism (see FIGS. 3A, 3B).

As illustrated in FIG. 3A, when the support platform 48 is open, the biasing mechanism 52 moves wall element 46 vertically upward in the direction of arrow 53 to an erected position. As illustrated in FIG. 3B, when support platform 48 is moved to the closed position, base 6 of the baby changing station acts upon wall element 46 and pushes it in the direction of arrow 55 against the bias of biasing mechanism 52. The biasing mechanism 52, is compressed and the wall element 46 is retracted into cavity 50 in a collapsed position and the support platform 48 is closed to lie flush against base 6 and the wall 8. Wall element 46 provides similar enhanced safety to a baby on platform 48 as the wall element 34 illustrated in FIG. 2 by increasing the effective depth of the platform top surface and confining a baby on the top surface between wall element 46 and base 6.

The changing station of FIG. 3 utilizes further different embodiments of the utility hooks 57 as illustrated by hooks, one of which holds a purse 59.

Figure 4A:
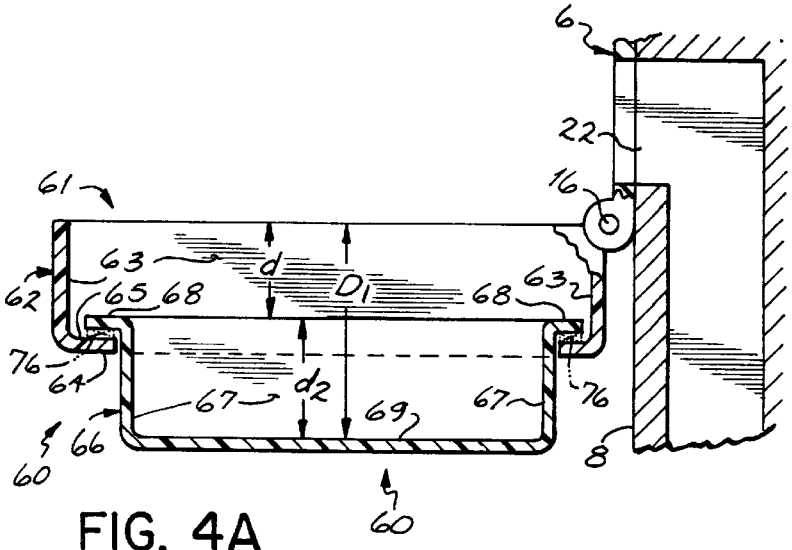
FIG. 4A is a side view, in partial cross-section, of an alternative embodiment of the baby changing station utilizing telescoping platform sections in the opened position.

FIG. 4A illustrates an alternative embodiment of the changing station of the invention which utilizes a support platform surface having an effectively deeper concavity than the platforms previously described. More particularly, the baby changing station 60 illustrated in FIGS. 4A and 4B utilizes a support platform 61 which comprises a first section 62 which is hingedly attached at one side to base 6 such as by hinges 16. The first section 62 is generally drawer-shaped and has side walls 63 and a lip 64 which is formed generally around the lower periphery of the first platform section 62. Lip 64 extends perpendicular to the side walls 63 of first section 62 and creates a horizontal ledge 65 around the lower periphery of the first section 62. A second platform section 66 is telescopically mounted within the first platform section 62. Second platform section 66 includes side walls 67 and a lip 68 which is formed peripherally around second platform section 66 along the top of section 66 and generally perpendicular to the side walls 67. The lip 68 rests on top of a spring biasing device 76 which, in turn, rest on ledge 65 formed by lip 64 such that first section 62 supports second section 66. When the support platform 60 is in a horizontal opened position, the second section 66 drops with respect to the first section 62 and is held suspended by the abutting lips 64, 68 of the respective platform sections. The cooperating platform sections 62, 66 provide a support platform 60 with a relatively deep concave surface 69 for receiving a baby thereon. Referring to FIG. 4A, the platform 60 has an effective depth D1, from the upper edge 71, which is approximately equal to the combined heights d and d2 of the first and second platform sections 62, 66.

Figure 4B:
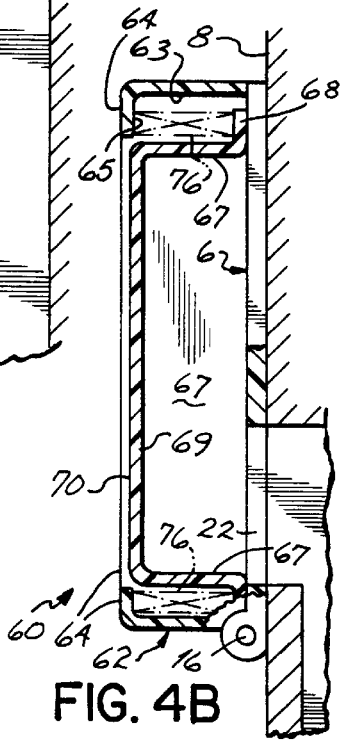
FIG. 4B is a side view, in partial cross section, of the baby changing station of FIG. 4A illustrating the support platform in the closed position against the wall.

When the support platform 60 is in an opened position as shown in FIG. 4A, the second platform section 66 telescopes away from the first platform section 62 to form the deep concave surface 69. When the platform 60 is hinged into a closed position up against base 6 as shown in FIG. 4B, the second section 66 is operable to telescope toward the first section 62 and toward the base 6 under the mechanical influence of the biasing device 76. Thus, when support platform 60 is closed, the second section 66 nests within the first section 62 and preferably nests completely within first section 62 such that a bottom surface 70 of the second section 66 lies generally flush with the bottom peripheral lip 64 of the first section 62. In that way, the support platform 60, in the closed position, will only project from the wall a predetermined length, such as four inches or less. However, when the support platform is open, the generally concave top platform surface 69 on which the baby rests has an effective depth D1, of close to twice the depths d, d2 of the first or second sections alone (e.g., 8 inches).

The spring-biasing device 76, may be a coil spring or flat spring and is coupled between the lips 64 and 68 of the respective platform sections. Coil springs may be positioned around the periphery of the support platform between the two telescoping sections. Alternatively, flat springs might be placed at each side for smooth telescoping of the sections. When the support platform 60 is closed, the devices 76 drive the lips 68 and second section 66 toward the first section 62 and against base 6 thereby reducing the effective projection depth of the closed baby changing station 60 from the wall 6. When the platform is open, the devices 76 flex to allow movement of the second section 66 away from first section 62 As may be appreciate, the weight of the second section 66 and the strength of the biasing devices 76 may be chosen such that simply opening the support platform 61 will cause the two platform sections to telescope. Alternatively, the devices 76 may operate such that the two sections 62, 66 remain nested together until the weight of a baby telescopes them apart to form a deep platform 69.

Figure 5A:
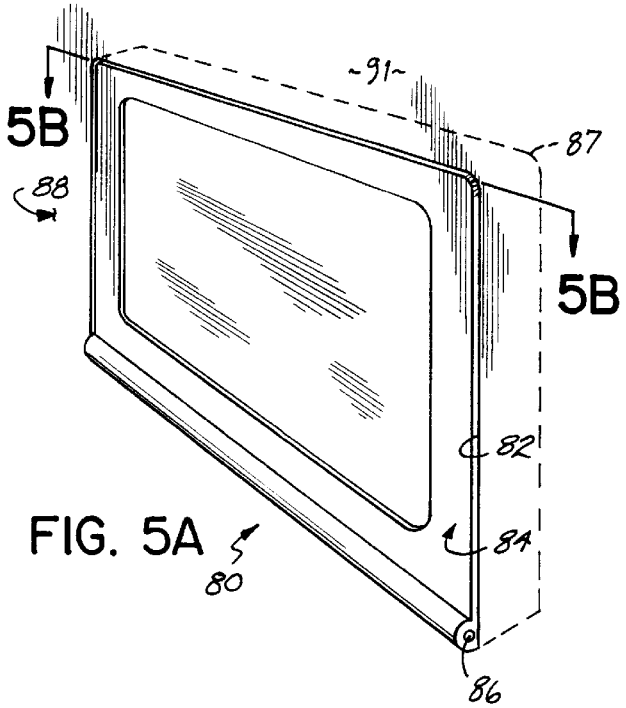
FIG. 5A is a perspective view of an alternative embodiment of the baby changing station of the present invention.
Figure 5B:
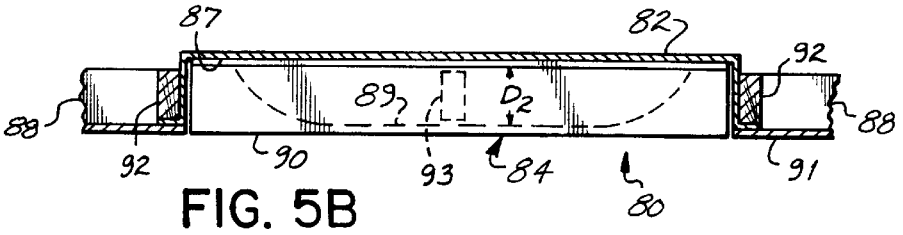
FIG. 5B is a top view, in partial cross-section, along lines 5B—5B of FIG. 5A illustrating the platform in the closed position and inset within the wall.

FIGS. 5A and 5B illustrate an alternative embodiment of the baby changing station of the invention which is constructed with a recessed platform. The baby changing station 80 includes an outer base casing 82 which is configured to receive a support platform 84 which is hingedly mounted to a lower side of the casing 82 by an appropriate hinge structure 86. The casing 82 is inset into a recess 87 formed in a wall 88. Platform 84 includes a generally concave top surface 89 for receiving a baby (not shown). The effective depth $D_2$ of the surface 89 may be generally greater than the projection dimensioned allowed by applicable building codes because of the unique construction of the station 80 and its cooperation with a recess 87 formed in wall 88. When the platform 84 is in the closed position, the base casing 82 receives the platform and top surface 89 within the wall 88. Preferably, the bottom surface 90 of platform 84 is flush with the wall surface 91. Alternatively, platform 84 may have a depth which makes the bottom surface 90 spaced from wall surface 91 when the platform is in the closed position. Accordingly, platform 84 may be dimensioned to have an effective depth $D_2$ greater than four inches and the station 80 will still comply with the applicable building codes when in the closed position.

The base casing 82 is mounted on either side to a wall stud 92 for support. Due to the length of the baby changing station 80, it would usually span across at least one stud. Any stud, such as center stud 93, which is spanned by the baby changing station 80 would need to be cut above and below the baby changing station with the wall 88. The inset baby changing station 80 may be partially inset into a wall recess or may be almost completely inset as shown in FIG. 5B.

As mentioned hereinabove, baby changing stations are particularly subject to defacement, and usually will have to be replaced when extensive vandalism occurs. The present invention addresses the issues of vandalism and particularly addresses the drawbacks of currently existing changing stations.

Figure 6:
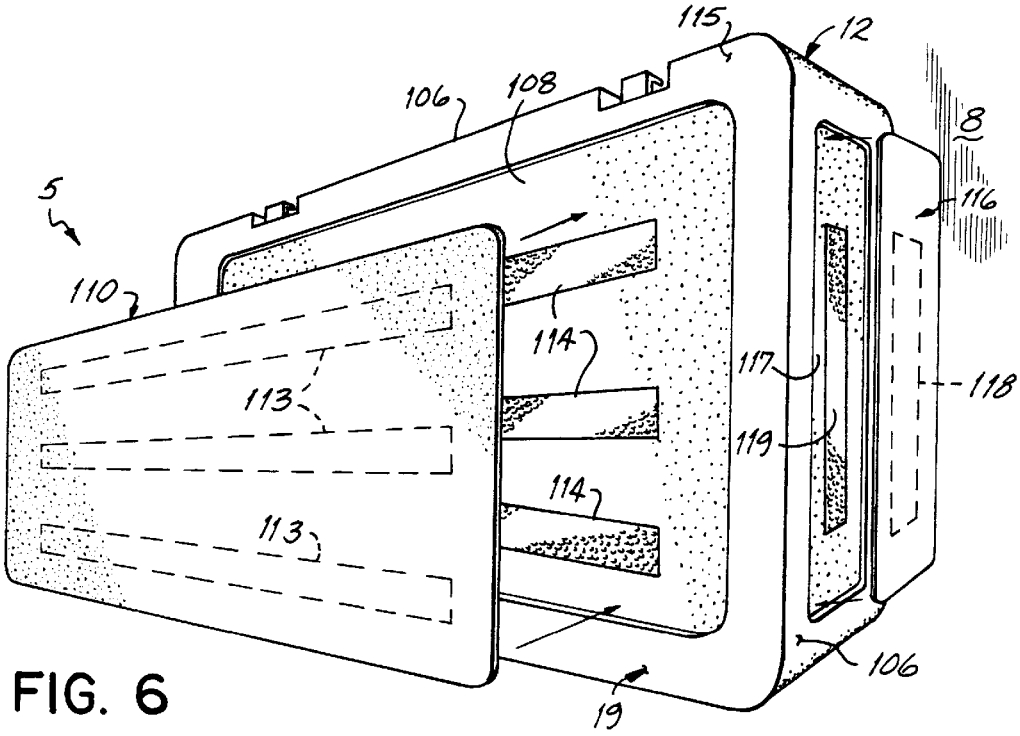
FIG. 6 is a perspective exploded view of the baby changing station of the invention illustrating the protective panels of the invention shielding the bottom surface and side surfaces of the platform.

To that end, FIG. 6 illustrates a perspective view of the baby changing station 5 of FIG. 1 illustrating a support platform 12 in the closed position against a wall-mounted base (not shown in FIG. 6). Support platform 12 has a bottom surface 19 and side surfaces 106. A recess 108 is formed within bottom surface 19 and the recess 108 is configured for holding a generally flat protective panel 110. The protective panel 110 is preferably a laminate and is colored appropriately in a wide variety of colors to match the color of the wall surface 8 to which the baby changing station 5 is mounted. Protective panel 110 is secured to bottom surface 19 within recess 108 by appropriate fastening structures. FIG. 6 illustrates opposing strips of hook and loop fasteners (such as VELCRO®) brand hook and loop fasteners 113, 114 respectively. Protective panel 110 fits within recess 108 to preferably mount flush with a border section 115 of the bottom surface 19 of support platform 12. When support platform 12 is in a closed position and mounted up against the base as shown in FIG. 6, decorative panel 110 overlies a large portion of bottom surface 19 and provides a protective exposed surface. The panel 110 is formed of an abrasion resistant material that is more durable than the material of the platform which is usually a molded plastic material. Protective panel 110 may be readily installed by aligning hook and loop fastening strips 113, 114 and pressing the panel 110 to surface 19. The panel is just as readily removed by pulling panel 110 away from bottom surface 19. Alternatively, decorative panel 110 might be fastened to bottom surface 108 by a more permanent means such as an adhesive (not shown).

The protective panel 110 protects the exposed bottom surface 19 of the platform 12. When vandals deface the changing station 5, such as with graffiti, the protective panel 110 may be easily removed and replaced, thus providing a clean, undamaged appearance to the changing station. In that way, the entire station or platform 12 does not have to be replaced. The protective panel 110 thus results in a substantial reduction in replacement costs.

A decorative side panel 116 might also be utilized on the side surface 106 and may be fixed within a recess 117 formed within support platform 12. Opposing hook and loop fasteners strips 118, 119 secure panel 116 to side surface 106.

Furthermore, the bottom surface 19 of the platform 12 provides a large surface area, and therefore, has a high visibility to a person within a restroom facility. Furthermore, the bottom surface 19 is most often seen because the changing station 100 is usually closed. However, the limited selection of neutral colors of existing changing apparatuses often does not match the color schemes in the facilities in which they are used. Accordingly, existing changing apparatuses, when closed, present large, obvious structures projecting from the wall which clash with the decor of the restroom or other facility. In accordance with the principles of the present invention, the changing station of the invention addresses such a drawback.

The protective panel 110 is preferably decorated with a number of different patterns and colors and may be decorated with wallpaper which matches wallpaper in a restroom facility. The protective panel 110 of the present invention therefore may be used to make the changing stations blend more appropriately into the decor of the restroom or other facility. Since the support platform 12 and base 6 will generally be a neutral color, the colored or patterned protective panel 110 will control the overall aesthetic appearance of the baby changing station 5.

Figure 7A:
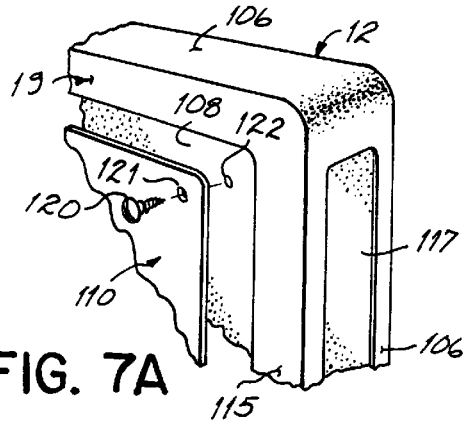
FIG. 7A is a partial perspective view of a corner of the baby changing station of FIG. 6 illustrating an alternative attachment feature for coupling the protective panel to the platform.

FIG. 7A illustrates an alternative fastening structure for fixing decorative panel 110 to bottom surface 19 of support platform 102. As shown, a screw or rivet 120 might be placed through an aperture 121 formed in the panel 110 and into hole 122 formed in bottom surface 10. Screws 120 placed in all four corners of the decorative panel 110 are sufficient to secure the panel to the support platform 12 and will provide ready removal of the panel, if necessary, such as to replace a defaced panel or to change the station to a different color.

Figure 7B:
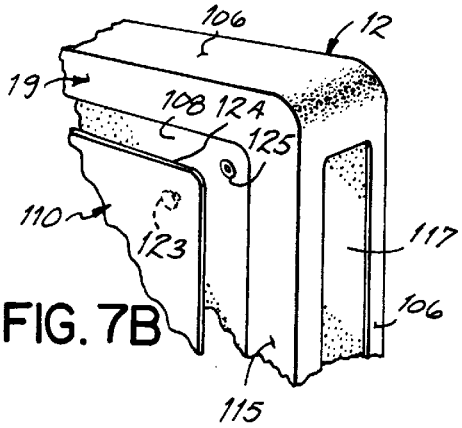
FIG. 7B is a partial perspective view of a corner of the baby changing station of FIG. 6 illustrating an alternative attachment feature for coupling the protective panel to the platform.

FIG. 7B illustrates still another fastening structure embodiment in which a tab or other structure 123 protrudes rearwardly from a back face 124 of the decorative panel 110. The tab 123 fits within a shaped aperture 125 formed in bottom surface 104. Tab 123 is than snapped into and out of aperture 125 to secure and remove the decorative panel 110, respectively.

Figure 8:
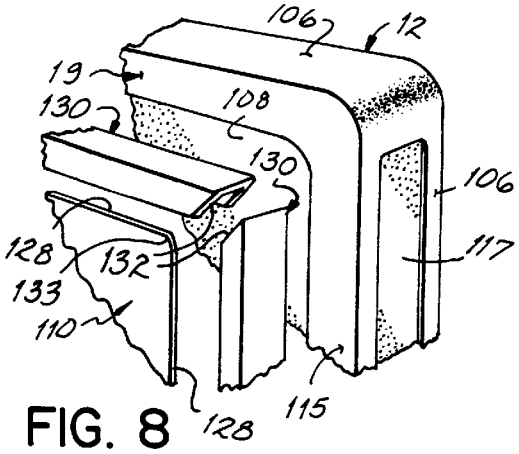
FIG. 8 is a partial perspective view illustrating a frame structure for coupling the protective panel to the platform.

FIG. 8 illustrates still another structure for affixing the protective panel 110 to the bottom surface 19 of the support platform 12. Protective panel 110 is surrounded along its edges 128 by frame members 130. The frame members 130 surround panel 110 and have beveled ends 132 which meet to form a frame structure with right angles at the corners 133 of panel 110. Panel 110 is held within the frame structure formed by the frame members 130 and the frame structure is then secured to bottom surface 19 by appropriate fastening structures such as hook and loop fasteners, adhesives, screws or tabs. The frame members 130 may be dimensioned such that the completed frame structure fits within recess 108 formed in the bottom surface 19 such that the frame structure is surrounded by border portion 115. Such a configuration yields a unique double border decorative panel further enhancing the aesthetic appearance of the station 5 when in the closed position. Alternatively, the frame members 130 might be dimensioned such that they form a frame structure which overlaps the border portion 115 such that the protective panel 110 is surrounded by a single border.

Figure 9:
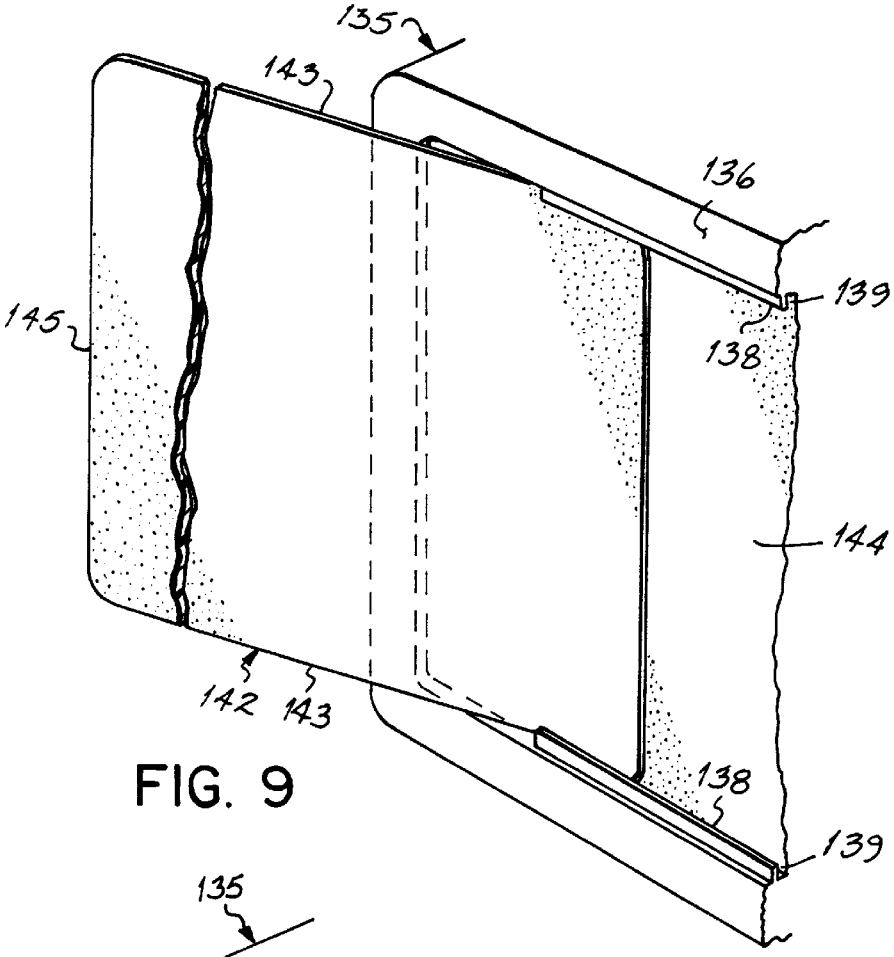
FIG. 9 is a partial perspective view of the baby changing station illustrating an alternative feature of the invention for securing the protective panel of the invention to the platform.

FIG. 9 illustrates an alternative protective panel assembly. Support platform 135 has a bottom surface 136. Opposing lip structures 138 along opposing edges of the bottom surface 136 form opposing grooves 139. The lip structures 138 extend toward each other in a plane generally parallel to the plane of the bottom surface 136. Upper and lower edges 143 of the decorative panel 142 are positioned within each opposing grooves 139 and the lip structures 138 hold the panel against the bottom surface 136.

Figure 10:
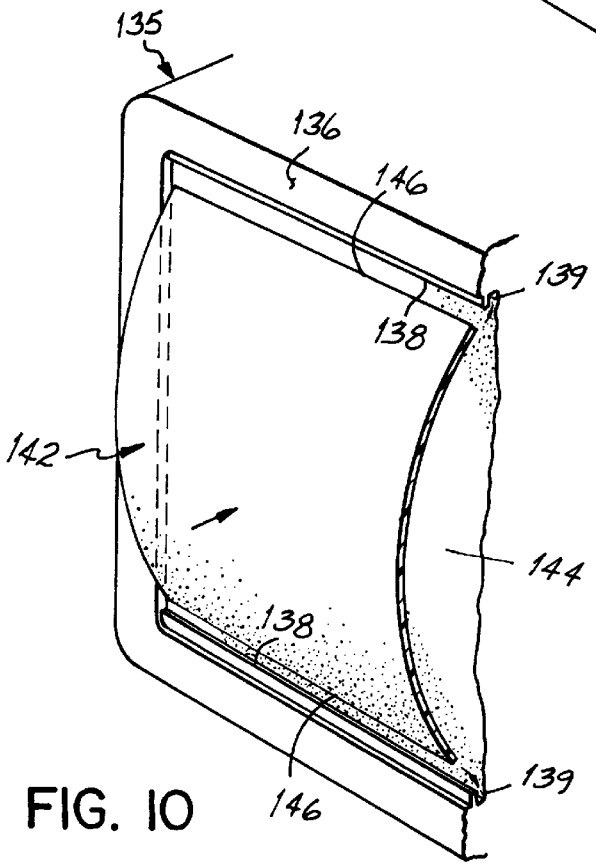
FIG. 10 is a partial perspective view of the baby changing station illustrating an alternative feature of the invention for securing the protective panel of the invention to the platform.

As illustrated in FIGS. 9 and 10, the opposing lip structures 138 extend toward each other within recess 144 formed in the bottom surface 136 of support platform 135. As may be appreciated, the bottom surface 136 may not have a recess and the lip structures 138 would thereby be formed simply to protrude outwardly from the bottom surface 136. As illustrated in FIG. 9, the lip structures 138 may be dimensioned in length such that the structures 138 do not extend the entire width of the recess and the decorative panel 142 may slide into the grooves 139 as shown in FIG. 9 with side 145 of the panel effectively snapping into the side of recess 144. Alternatively, the lip structures 138 may extend the width of platform 135 such that decorative panel 142 may be flexed as illustrated in FIG. 10 so that the edges 146 of the panel slide into the opposing grooves 139. The opposing lip structures 138 and grooves 139 eliminate the necessity of separate fastening structures to secure panel 142 to the bottom surface 136. In still alternative embodiments, the platform 135 may have three or four lip structures (not shown) on the respective sides of the platform for securing the panel 142. The panel 142 would then be snapped or slid into position.

When changing a baby, the person must have the necessary supplies, such as extra diapers, powders, lotions, and moist baby wipes for the task. With existing baby changing apparatuses parents or caregivers are presented with the undesirable choice of placing the supplies on a dirty and often unsanitary restroom floor, or wedging the supplies onto the changing surface with the baby. Supplies placed on the changing surface are subject to being inadvertently knocked or spilled onto the floor by a squirming baby or unintentionally by parents or caregivers. Furthermore, such supplies may be uncomfortable to a baby. In addition to the utility channel 24 of the changing station of the invention, the changing station further comprises accessory hooks for receiving diaper bags or purses.

Figure 11:
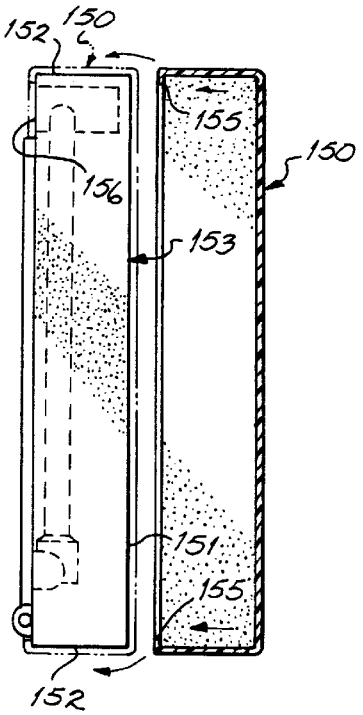
FIG. 11 is a perspective view of the changing station of the invention in the closed position illustrating a protective cap utilized with the protective panel.

FIG. 11 illustrates another alternative embodiment of the protective panel of the present invention. Protective panel 150 is configured in the form of a cap which is dimensioned to fit over bottom surface 151 and side surfaces 152 of support platform 153. As illustrated in phantom in FIG. 11, when cap 150 is placed over platform 153, the platform is protected with a laminated shell to prevent permanent damage from defacement such as graffiti. The protective panel 150 includes a peripheral lip 155 which overlaps partially onto the top surface 156 of the platform 153 in order to secure the protective panel 150 to the platform 153. Therefore, in the closed position, platform 153 is protected from vandalism. If any damage or marking occurs on the panel 150, the panel may simply removed from platform 153 and replaced with a new, clean protective panel.

Figure 12A:
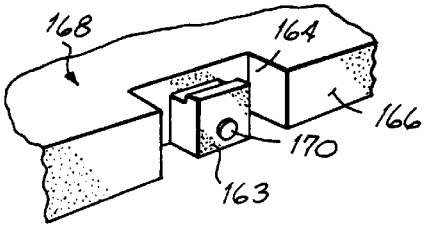
FIGS. 12A, 12B, 12C and 12D illustrate various embodiments of utility hook structures of the present invention.

As illustrated in FIGS. 1, 2, 3, and 9A–9D, the present invention comprises accessory hook structure which protrude from the support platform and are configured for receiving and supporting diaper changing supplies such as a diaper bag. As shown in FIG. 3, the hook structure 57 maintains diaper bag 59 off of a restroom floor in a position which is relatively close to and within access of the top surface of the support platform 48. Thereby, supplies in the diaper bag 59, such as extra diapers, will be readily at hand during diaper changing. While the accessory hook structure 57 is shown protruding outwardly from the platform, the hook structure might also be mounted to protrude outwardly from an upper edge of the platform. For example, FIG. 12A illustrates an outwardly projecting hook structure 163 which fits within a recess 164 formed in a side surface 166 of the support platform 168. Hook structure 163 is secured to support platform 168 by a suitable fastening mechanism such as a bolt or a screw 170.

Figure 12B:
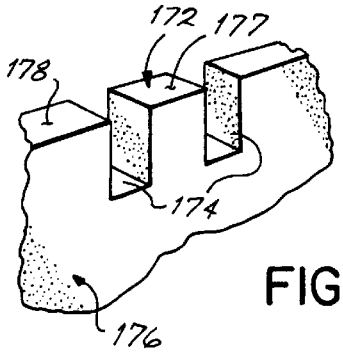
Figure 12C:
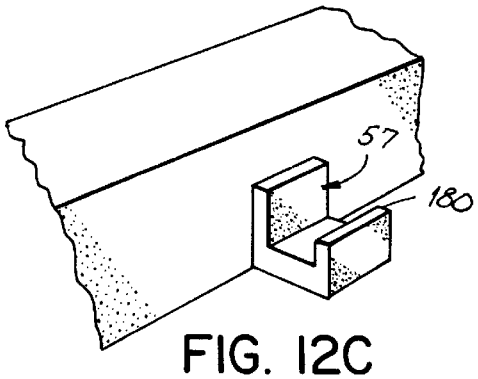

FIG. 12B, on the other hand, illustrates a hook structure in the form of an upstruck tooth which is preferably integrally formed with the platform. As illustrated in FIG. 12B, the upstruck tooth 172 is formed by cutaway portions 174 of the platform 176. In that way, the top edge 177 of tooth 172 is flush with the top edge 178 of platform 176.

FIG. 12 is an enlarged view of the hook structure 57 shown in FIG. 3 and includes upstruck portion 180 which keeps the straps of a diaper bag 59 from sliding off of the hook structure 57 Hook structure 57 is secured to the surface of platform 48 such as by an adhesive (not shown) or other suitable securing structure.

Figure 12D:
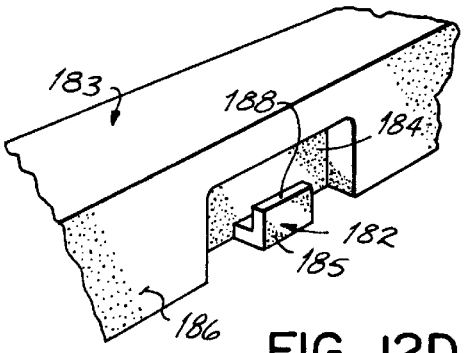
Figure 13:
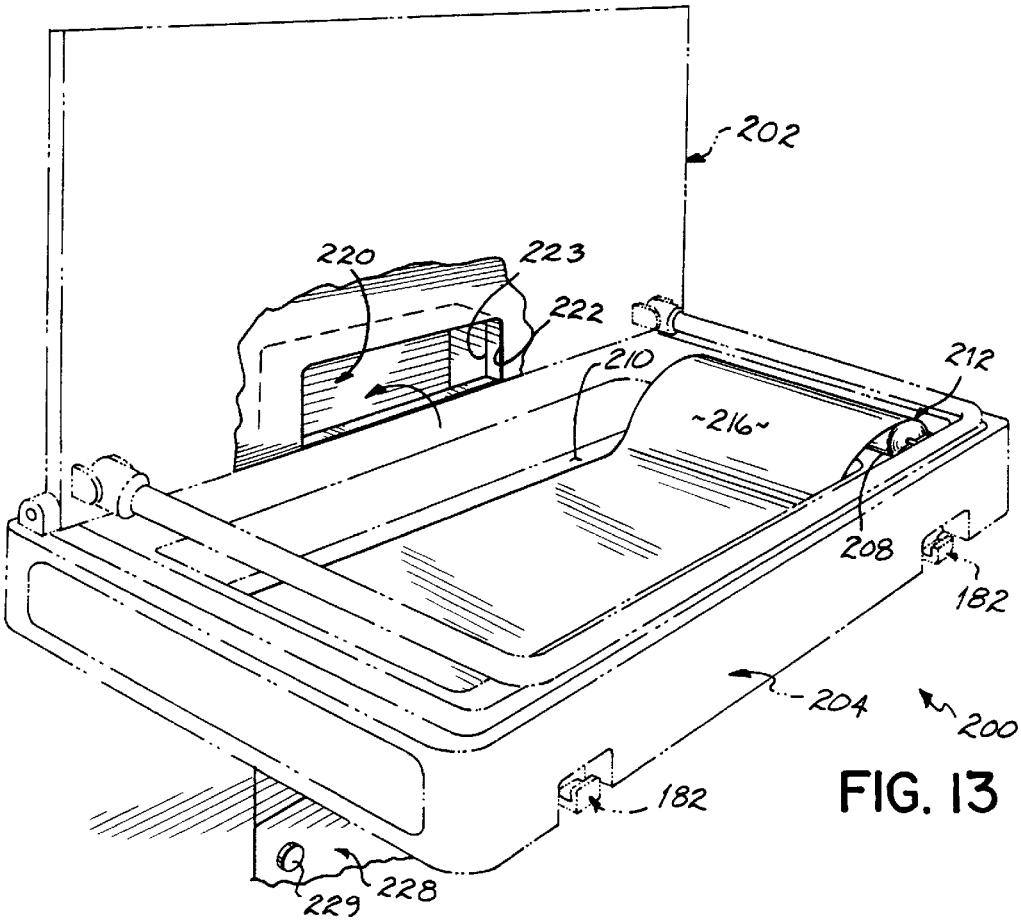
FIG. 13 is a perspective view of the baby changing station of the invention illustrating the sanitary paper roller and waste chute with an integrated waste receptacle.

FIGS. 12D and 13 illustrate an integrally formed hook structure 182 which sits recessed in the platform 183 in a recess 184 formed therein. FIG. 1 illustrates hook structures 28 similar to hook structure 182. The front face surface 185 is preferably flush with a side surface 186 of the platform 183. Hook structure 182 includes an upstruck portion 188 for preventing bag or purse straps from sliding off the hook structures. The hook structures are configured so that the platform may lie flat against a wall in the closed position.

FIG. 13 illustrates an embodiment of the baby changing station of the invention which always provides a clean and sanitary changing surface despite normal usage. The baby changing station 200 includes a base 202 and a support platform 204. Support platform 204 includes a concave top surface 210 as discussed above. A cylindrical log-shaped cavity 208 is formed proximate the top surface 210 of platform 204 at an end of the platform. A roll of paper 212, either in a continuous sheet or alternatively in perforated sheets, is positioned to roll in the cavity 208. Paper is pulled from the roll 212 from one end of the platform 204 to the other end. The paper 216 is dispensed to cover a portion of top surface 210 and specifically the concave portion on which the baby lies. The paper 216 is preferably a sanitized paper to provide a sanitary surface on which to change the diapers of a baby. After diaper changing, the paper 216 is severed at the end proximate roll 212, such as by tearing the paper or separating the paper along a pre-formed perforated line. The soiled or used paper is removed and a fresh paper lining is dispensed onto the concave top portion 210 for the next changing. Thereby, the surface on which the baby is changed remains sanitary and clean, making the baby changing station of the present invention further inviting to a parent who desires to change their child's diapers, but does not desire to rest the baby on a dirty changing surface which has been previously used several times without cleaning. Roll 212 is easily removed from the cavity 208 for replacement with a fresh supply of paper when the roll has been exhausted.

Figure 15:
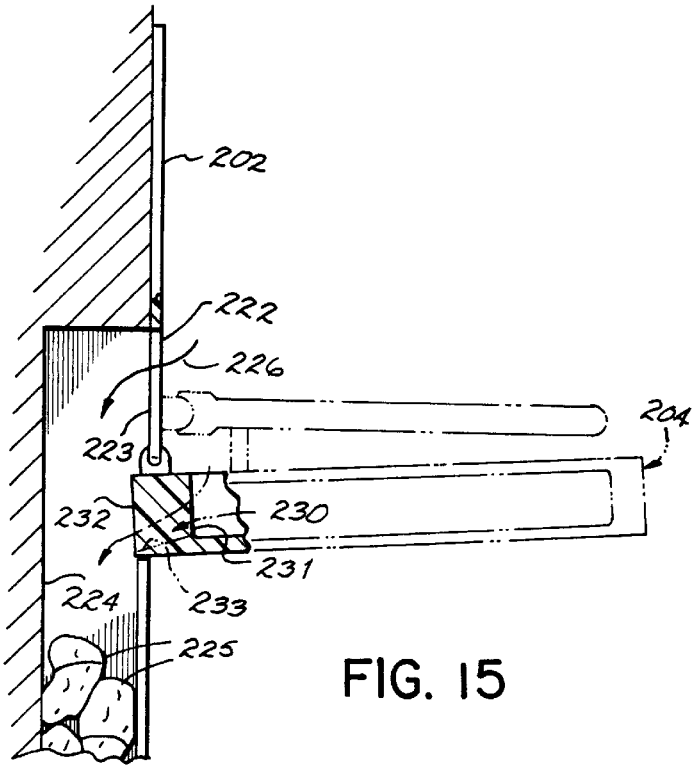
Figure 14:
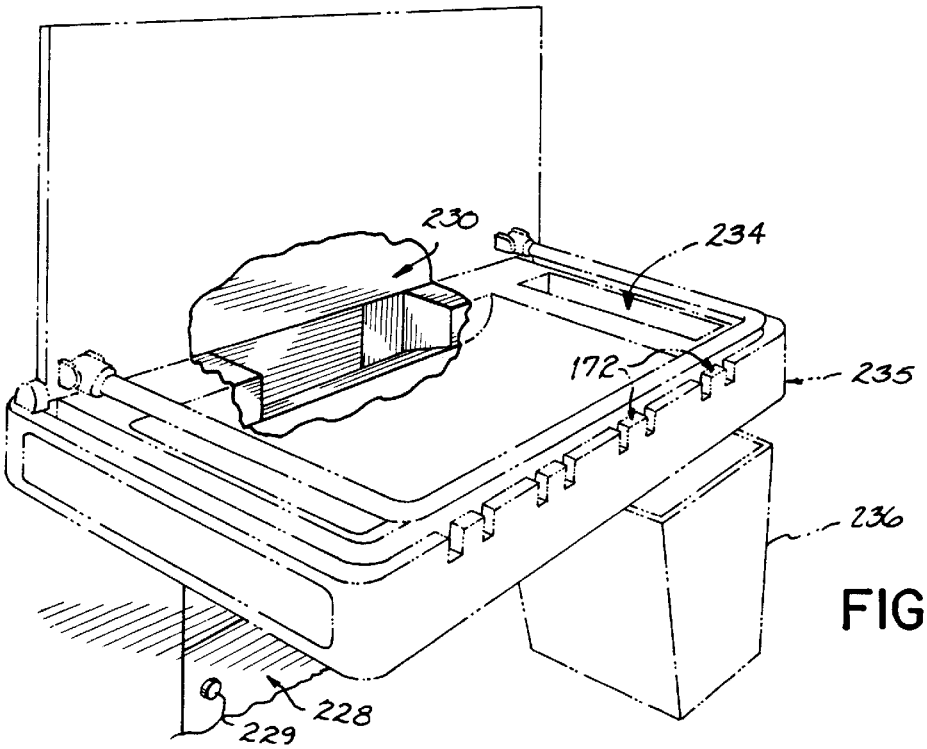
FIG. 14 is a perspective view of the baby changing station of the invention illustrating alternative waste chutes and waste receptacles in accordance with the principles of the present invention; and, FIG. 15 is a side view of the changing station of FIG. 13.

After a baby's diapers have been changed, dirty diapers and dirty wipes and other used accessories remain and must be disposed of properly. With existing changing stations, the parent is left with the dilemma of disposing of the waste products and leaving the baby briefly unattended because usually the waste receptacle is located in an area remote from the baby changing apparatus. In accordance with another aspect of the present invention, the baby changing station is integrated with a dedicated waste receptacle so that a parent can quickly and easily dispose of waste products including dirty diapers without leaving the baby. Referring again to FIG. 13, the baby changing station 200 comprises a waste chute 220 formed in the base 202. Waste chute 220 is illustrated as chute 22 in FIGS. 1, 2, 3, 4A and 4B. Chute 220 includes an inlet end 222 and an outlet end 223 (see FIG. 15). The inlet end 222 is formed proximate the top surface 210 of platform 204 to be readily accessed. The outlet 223 end terminates at the mouth of an integrated waste receptacle 224 (see FIG. 15). Any waste placed in the inlet end 222 is directed to the outlet end 223 and into the waste receptacle 224. The waste receptacle 224 may be recessed within the wall to which the baby changing station 200 is mounted or it may be surface mounted to the wall below the baby changing station 200. Dirty diapers and other waste products 225 are then simply tossed into waste chute 220 as illustrated by arrow 226 whereupon they are guided into waste receptacle 224. As illustrated in FIGS. 13 and 15, the waste chute may be formed as an opening through the base 202 which is aligned with the mouth of receptacle 224. Alternatively, as illustrated in FIGS. 14 and (in phantom), the waste chute may be formed in the platform as is waste chute 230. Waste chute 230 has an inlet end 231 and an outlet end 232. As illustrated in phantom in FIG. 15, when the platform 204 is in the opened position, the outlet end 232 aligns with the mouth of receptacle 224. A sloped floor 233 (shown in phantom in FIG. 15) extends generally from inlet end 231 to outlet end 232 to guide waste to the waste receptacle 224. Waste receptacle 224 may be provided with a door 228 with a latch 229 which may be opened for emptying the waste receptacle 224 when it has become full.

FIG. 14 illustrates another alternative embodiment of the waste chute. Waste chute 234 is formed in platform 235 at an end thereof. Chute 234 empties into a waste receptacle 236 as positioned on the floor beneath the platform 235. The outlet end (not shown) of chute 234 is aligned with the mouth of receptacle 236 when waste chutes 220, 230 and 234 provide rapid disposal of dirty diapers and other waste without having to leave the baby unattended. In that way, the safety of the child is enhanced with the baby changing station of the present invention and the messes and smells often associate with baby changing stations can be reduced or eliminated. A swinging door (not shown) may be placed over the inlet end of the waste chutes to separate the platform from the water receptacle and contain any smells therein.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A wall-mounted station for changing the diapers of a baby comprising:

a support platform having top and bottom surfaces and opposing sides, the support platform being hingedly fixable at one side with respect to a wall;

the support platform being movable between a closed position up against a wall wherein the platform top surface is partially hidden from view and the bottom surface is exposed for view and an opened position hinged away from a wall wherein the support platform is disposed generally perpendicular to a wall and the top surface is exposed for receiving a baby;

a generally flat protective panel, formed of a non-glass, abrasion-resistant material, the platform bottom surface being configured for receiving said panel such that said panel overlies at least a portion of the platform bottom surface and covers the exposed bottom surface of the platform when the support platform is in a closed position to create vandalism proof support platform for reducing the effects of graffiti and abrasions on the platform and for improving the inner decor of a facility in which the changing station is installed.

2. The baby changing station of claim 1 further comprising at least one aperture formed in the bottom surface of the support platform and a fastener configured to be received by the aperture, the fastener being in operable contact with the protective panel to secure the panel to the bottom surface when placed in the aperture.

3. The baby changing station of claim 1 further comprising a hook and loop fastener structure operably coupled between said protective panel and said platform bottom surface to secure the panel to the bottom surface.

4. The baby changing station of claim 1 wherein the bottom surface has opposing side edges and the support platform comprises a groove along at least one side edge of the bottom surface, the groove configured to receive an edge of the protective panel for securing the panel to the support platform.

5. The baby changing station of claim 1 wherein the support platform includes a second groove positioned along an edge opposite the first groove, the protective panel being slidable between the opposing grooves for securement to the platform bottom surface.

6. The baby changing station of claim 1 further comprising a protective cap structure surrounding the protective panel, the cap structure configured to engage the platform and secure the panel to the platform.

7. The baby changing station of claim 6 wherein the protective panel is integrally formed with the protective cap structure.

8. A wall-mounted station for changing the diapers of a baby comprising:

a support platform having top and bottom surfaces and opposing sides, the support platform comprising a first section hingedly fixable at one side with respect to a wall and a second section telescopically mounted with the first section;

the support platform being movable to an opened position wherein the first section is hinged away from a wall and is disposed generally perpendicular to a wall, the second section operable for telescoping away from the first section in the opened position to define an effective depth for the support platform for receiving a baby thereon;

the platform further being movable to a closed position wherein the first section is hinged up against a wall, the second section further operable for telescoping toward the first section in the closed position to nest partially within the first section and form a relatively thin platform against a wall surface which is compliant with building regulations.

9. The baby changing station of claim 8 wherein the second section is telescopically mounted inside of the first section and includes a lip around a top periphery thereof which rests against a lip along a bottom periphery of the first section to hold the sections together when the platform is in the opened position.

10. The baby changing station of claim 8 further comprising a biasing device coupled between said first section and said second section, the biasing device driving the second section toward the first section to nest the two sections together when the platform is in the closed position.

11. The baby changing station of claim 10 wherein the biasing device comprises a spring.

12. The baby changing station of claim 8 wherein the first section is configured to completely receive the nested second section when the second section is telescoped toward the first section.

13. The baby changing station of claim 8 wherein the platform first section comprises a generally concave top surface to receive a baby, the top surface extending into the first section with respect to an upper edge of the first section to increase the effective depth of the platform.

14. A wall-mounted station for changing the diapers of a baby comprising:

a base configured for vertical mounting to a wall;

a support platform having top and bottom surfaces and opposing sides, the support platform hingedly fixed at one side with respect to the base;

the support platform being movable between an opened position wherein the support platform is hinged away from a wall and is disposed generally perpendicular to a wall for receiving a baby and a closed position up against the base;

a chute formed in one of the platform and the base, the chute having an inlet end proximate the platform top surface and extending downwardly from said top surface to an outlet end;

a waste receptacle positioned below said chute and proximate the outlet end when the platform is in the open position, the chute configured to receive waste products from the changing of diapers of a baby which are placed in the inlet end of the chute and operable to direct the waste products to said waste receptacle.

15. The baby changing station of claim 14 wherein said chute is formed in said platform and the inlet end is positioned proximate a side of the platform such as to be generally away from a baby on the platform top surface for unobstructed access to the chute.

16. The baby changing station of claim 14 wherein the waste receptacle is configured to be mounted inset within the wall to which the station is mounted, the waste receptacle having an opening which aligns with said chute inlet end when the receptacle is inset in the wall and the support platform is moved to the opened position.

17. A wall-mounted station for changing the diapers of a baby comprising:

an elongated and generally planar support platform having top and bottom surfaces, and opposing sides, the support platform hingedly fixable at one side with respect to a wall;

the support platform being movable between an opened position wherein the platform is hinged away from a wall and is disposed generally perpendicular to a wall for receiving a baby and a closed position up against a wall;

a utility channel formed in said platform proximate a side of the platform, the utility channel being formed in the platform around the top surface generally coextensive with at least two adjacent sides of the platform to be accessed from various positions around the baby changing station and being configured for holding supplies for changing the diapers of a baby to be in readily accessible from the top surface for producing an easy, convenient changing environment.

* * * * *

UNITED STATES PATENT AND TRADEMARK OFFICE

CERTIFICATE OF CORRECTION

PATENT NO. : 6,049,928
DATED : April 18, 2000
INVENTOR(S) : John A. Helmsderfer

It is certified that error appears in the above-identified patent and that said Letters Patent is hereby corrected as shown below:

Column 12,
Line 55, reads "station or", and it should read -- station 5 or --.

Column 16,
Line 13, reads "in FIGS. 14 and (in", and it should read in FIGS. 14 and 15 (in --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*